United States Patent [19]

le Bars

[11] Patent Number: 4,546,890

[45] Date of Patent: Oct. 15, 1985

[54] AUTOMATIC HOIST AND TRAVERSING APPARATUS

[76] Inventor: Christian le Bars, 22, rue de Montfort, 78190 - Trappes, France

[21] Appl. No.: 571,795

[22] Filed: Jan. 18, 1984

[30] Foreign Application Priority Data

Jan. 18, 1983 [FR] France ..... 83 00668
Dec. 5, 1983 [FR] France ..... 83 19384

[51] Int. Cl.[4] ..... B66C 21/00

[52] U.S. Cl. ..... 212/98; 212/100; 212/104

[58] Field of Search ..... 212/98, 92, 116, 118, 212/126, 131, 161, 73, 71, 119, 142.1, 216, 214, 97, 100, 101, 104, 99, 102, 105

[56] References Cited

U.S. PATENT DOCUMENTS

| | | | |
|---|---|---|---|
| 221,342 | 11/1879 | Myers | 212/98 |
| 237,571 | 2/1881 | Messier | 212/97 |
| 271,276 | 1/1883 | Rowell | 212/98 |
| 551,586 | 12/1895 | Hullett | 212/98 |
| 615,043 | 11/1898 | Pett | 212/98 |
| 1,138,007 | 5/1915 | Newell | 212/98 |
| 1,640,624 | 8/1927 | Steinmayer | 212/102 |
| 3,630,390 | 12/1971 | Tax | 212/161 |

*Primary Examiner*—Trygve M. Blix
*Assistant Examiner*—Thomas J. Brahan
*Attorney, Agent, or Firm*—Brisebois & Kruger

[57] ABSTRACT

This invention relates to hoisting and traversing apparatus, and particularly to automatic hoisting and traversing apparatus which requires only a single motor for both hoisting and traversing. More particularly, the invention relates to a hoisting and traversing system in which the cable or chain which lifts the load can also be used to control the traversing movements of the load.

11 Claims, 31 Drawing Figures

AUTOMATIC HOIST AND TRAVERSING APPARATUS

BACKGROUND OF THE INVENTION

Hoisting apparatus is known, in which a hoisted load is traversed or moved manually, but in such apparatus the movement or manipulation is dangerous and requires a worker to be present at both the location of loading and the location of unloading. With such prior known apparatus, the worker at the loading station controls the lifting of the load, and after it is transferred to the unloading station, the worker at this next station is required to control the lowering of the load.

Traversing the load in such prior devices has required a worker to either push the load manually to the next station after it is hoisted, or the worker operated a separate traversing motor to move the load to the next station. Where the load is moved manually, heavy loads have a tendency to swing on the supporting cable or chain, and can cause injury. Also there is always the danger that the cable or chain will slip as a result of a malfunction of the hoisting device or its drive motor, causing the load to fall or be lowered on the worker.

Where a separate motor is used to traverse the load, it has been customary to mount the hoisting motor on the movable carriage, which requires flexible power lines such as flexible electrical cables, pneumatic lines, or hydraulic lines, depending on the power requirements of motor used in the hoisting apparatus.

SUMMARY OF THE INVENTION

In accordance with the invention, the need for manual traversing of loads as well as a second motor to traverse hoisted loads is essentially eliminated.

In accordance with the invention, the load is automatically hoisted to a predetermined height in which the load is mechanically and positively locked and the weight of the load is released from the hoisting cable, and with the load in this locked position, the hoisting cable can then be used to control the traverse of the load, either along an inclined track, or against the action of a spring loaded winding return drum, which urges the carriage toward an initial position.

This dual action of the cable, in accordance with the invention, is permitted by passing the cable around a hoisting pulley so that the hoisting portion of the cable extends vertically from the pulley and the other portion of the cable extends generally horizontally toward a motor driven winding drum. The arrangement is such that when the load is hoisted to a predetermined level, a stop or ball fixed to the hoisting cable or to a hook at the end of the cable, is mechanically locked to the traversing carriage so that the horizontal run of the cable can be used to traverse the load. Also, the carriage is released so that the carriage can roll on the supporting track to the next station, while being controlled by the cable. When the carriage arrives at this next station, its traverse is automatically halted and the load is automatically lowered.

A hoisting cable slack detector can be used, if desired, to automatically return the carriage to the first station after the load is removed at the second station. Alternatively, a return control can be provided at the second station, and it will, of course, be appreciated and understood that loads can be moved to or from either of the stations.

In accordance with the invention, a stop is provided at each station and cooperates with the carriage mechanism to automatically arrest the traverse of the carriage and to then cause controlled lowering of the load. By virtue of the locking arrangement which locks the load to the carriage during movement between the stations, the only tension in the hoisting cable between the station is that required to traverse or control the traverse of the load. The locking is positive and failsafe and assures that the load cannot be lowered or released except at the stations.

In accordance with the invention, the locking arrangement for locking the load to the carriage includes a pivoting socket or fork which is pivoted in response to continued hoisting, to a position in which the socket cradles the ball or cable stop, and wheels associated with the socket move to a position onto the traversing track so that the load is positively held, and the hoisting cable is then used to control the traverse of the carriage and load along the track.

The invention also includes several embodiments of a reversing and lowering arrangement which cause the load to be automatically lowered when it reaches an unloading station.

In all embodiments, the hoisted load is locked to the carriage independently of the cable so that the same cable and motor which hoist and lower the load can then be used to control the traverse or displacement of the carriage along the track.

Numerous other features, objects, and advantages of the invention will become apparent with reference to the drawings and the detailed description which follow.

BRIEF DESCRIPTION OF DRAWINGS

FIGS. 3 through 8 are side views of a first embodiment according to the invention, with portions of the apparatus removed for purposes of illustration, and showing the apparatus in different operating positions, and in which:

FIG. 3 shows the apparatus as a load is being hoisted,

FIG. 4 shows the apparatus after the load is hoisted and is locked to the carriage, FIG. 5 shows a first step in the unloading at a next station, FIG. 6 shows the cable stop released from the carriage and the load being lowered, FIG. 7 shows hoisting of another load at the second station, and FIG. 8 shows the start of traverse toward the first station;

FIGS. 9 through 17 show a side view with portions removed for purposes of illustration of a second embodiment according to the invention in which:

FIG. 9 shows lifting of a load at a first station,

FIG. 10 shows continued lifting at the first station,

FIG. 11 shows the cable stop locked to the carriage and the carriage in a traversing condition, FIG. 12 shows initial movement of the carriage at the second station, FIG. 13 shows the initial phase of lowering the load at the second station, FIG. 14 shows the load being lowered, FIG. 15 shows an initial step of re-hoisting at the second station, FIG. 16 shows further hoisting at the second station, FIG. 17 shows the apparatus just before the carriage assumes the load locking position.

FIGS. 22 through 27 show schematically, the operation of a third embodiment of hoisting and traversing mechanism according to the invention, in which: FIG. 22 shows the apparatus during hoisting, FIG. 23 shows the load locked to the carriage and the carriage traversing, FIG. 24 shows the carriage as it reaches the second station, FIG. 25 shows the apparatus during the lowering of the load at the second station, FIG. 26 shows re-hoisting of a load at the second station, and FIG. 27 shows the load locked to the carriage at the beginning of traverse from the second station;

DETAILED DESCRIPTION

Figure 1:
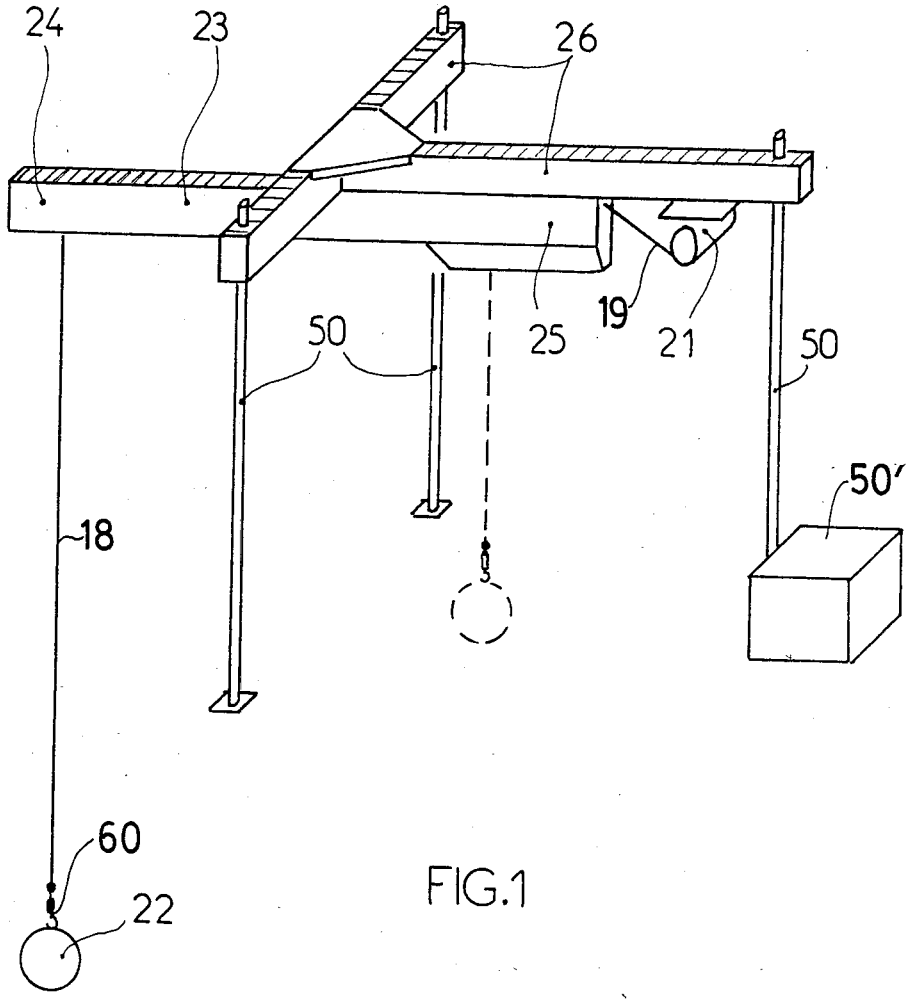
FIG. 1 is a pictorial view of an overall arrangement of apparatus according to the invention.

An overall arrangement according to the invention is shown at FIG. 1. As shown, there is a monorail or roller track 23 along which a movable carriage can traverse. Monorail 23 is supported by support rails 26 which in turn are supported on legs 50 which provide a tripod type of support arrangement. A counter weight 50′ can also be provided at one end of the center support rail 26 in association with the end leg 50 to counter balance the system when a load 22 is traversed to the position shown in full lines at FIG. 1. Roller track 23 has a first station 24 and a second station 25. For convenience of explanation, the first station 24 will be referred to from time to time as a locking station, and the second station 25 will be referred to as an unlocking station. A carriage mounted on roller track 23 can lift a load at either station and can then be traversed to the other station.

The load 22 is hoisted and lowered by a cable or chain 18 which can have a hook assembly 60 at its lower hoisting end. Cable 18 extends upwardly around a pulley (such as pulley 4 of FIG. 3) and then extends horizontally through the roller track 23 and its other end 19 is connected to a motor driven winding drum or winch 21. In accordance with the invention, both the hoisting and the traverse of the load between stations 24 and 25 is controlled by the cable 18 and the winch 21.

Figure 2:
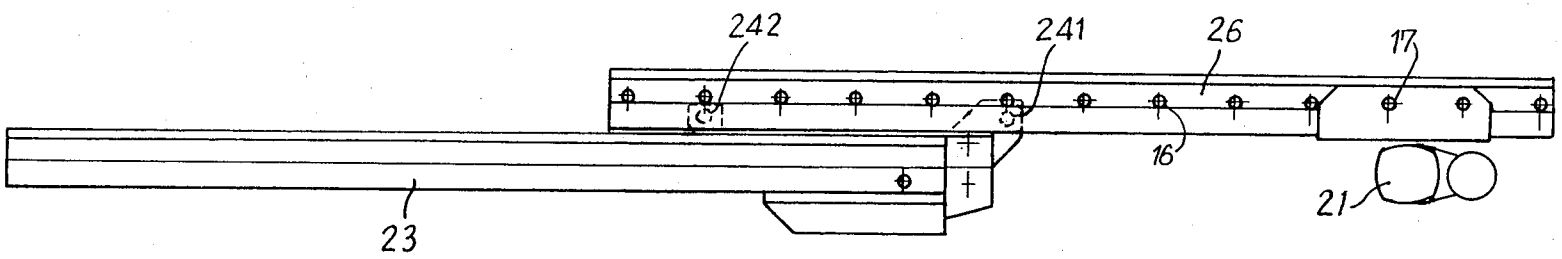
FIG. 2 is a side view of the monorail or track and its adjustable fastening arrangement.

As shown at FIG. 2, track 23 is connected to support rail 26 for longitudinal adjustment different positions on rail 26. For such movement, an axle 242 is provided which is slidable along rail 26. At the rear of roller track 23 is another axle 241 for fixing track 23 against longitudinal movement. Securing of axle 241 can be accomplished by clamps or wedges to fix track 23 against longitudinal movement. As shown at FIG. 2, the hoisting drum assembly 21 can also be moved and secured in different positions along rail 26. The openings 16 in rail 26 and the co-acting openings 17 in the winding drum support permit moving the winding drum to different positions along rail 26 and then securing the support in position by bolts inserted through then-aligned openings 16 and 17.

While the arrangement shown at FIG. 1 includes the upright legs 50 which support the rail 26 which in turn supports the roller track 23, it is to be understood that rails such as rails 26 could be fixed to overhead supports of a factory or building in which this apparatus can be used. The legs 50 shown at FIG. 1 can simply have support plates at their lower ends, as shown, which permit lifting and then moving the apparatus to any desired location for use, either indoors or outdoors. In addition, it may be desirable in some applications to provide locking wheels instead of support plates at the lower ends of the legs 50 so the apparatus can simply be rolled to different locations and immobilized by locking the wheels.

A first embodiment of hoisting and traversing apparatus according to the invention and its operation will now be explained with reference to FIGS. 3 through 8. Brief reference to FIG. 19, however, will facilitate this explanation.

Figure 19:
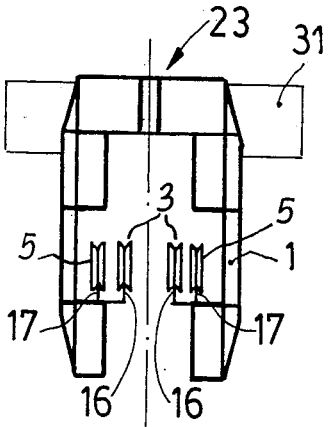
FIG. 19 is a schematic view in section of the track or monorail of the embodiments of FIGS. 3 through 18.

As shown at FIG. 19, the roller track 23 has a rail arrangement 1 which includes two pairs of roller supporting rails 16 and 17, the rails of each pair being spaced apart and on opposite sides of the longitudinal center-line of roller track 23.

Figure 3:
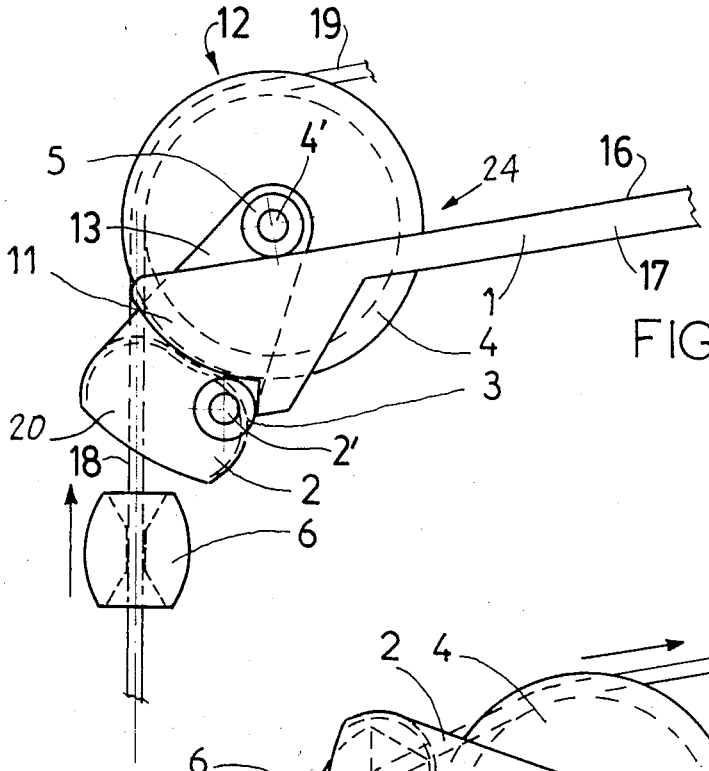

Referring to FIG. 3, carriage assembly 12 includes a grooved cable pulley 4 mounted on a central shaft 4′. A support roller 5 is mounted on each end of shaft 4′ (on opposite sides of pulley 4) so the rollers can rotate, but are fixed against axial movement on the shaft 4′. Rollers 5 are grooved and ride on rails 17, as shown at FIG. 19. Pivotally mounted on axle 4′ is a clevis assembly 13 having a cradle or socket 2 beyond the perimeter of pulley 4. An axle 2′ extends through socket 2, and rollers 3 which ride on rails 16 (FIG. 19) are mounted on opposite ends of axle 2′. The front end of rail arrangement 1, at first station 24 has arcuately curved ramps 11, which form a continuation of rails 16, so that clevis 13 can pivot downwardly and rollers 3 can ride downwardly around these ramps as shown at FIG. 3, when the carriage 12 reaches station 124. Stops limit pivoting to the position shown at FIG. 3.

Cable 18 extends over pulley 4, and downwardly through a vertical slot in cradle 2. The portion 19 of the cable extends to the winch 21.

Fixed to the cable 18 is a ball-like stop 6 of a larger dimension than the slot in cradle 2. This stop 6 is fixed adjacent to the lower end of the cable 18 so that just before the end of a hoisting operation, stop 6 engages in cradle 2. A continued pull in portion 19 of the cable after stop 6 engages cradle 12, causes yoke 13 to pivot clockwise until rollers 3 are lifted to a position above rack 1. As rollers 3 pivot upwardly around the nose or end of track 1 and leaves ramps 11, carriage 12 is released from station 24, and can traverse along track 1 as shown at FIG. 4.

Figure 4:
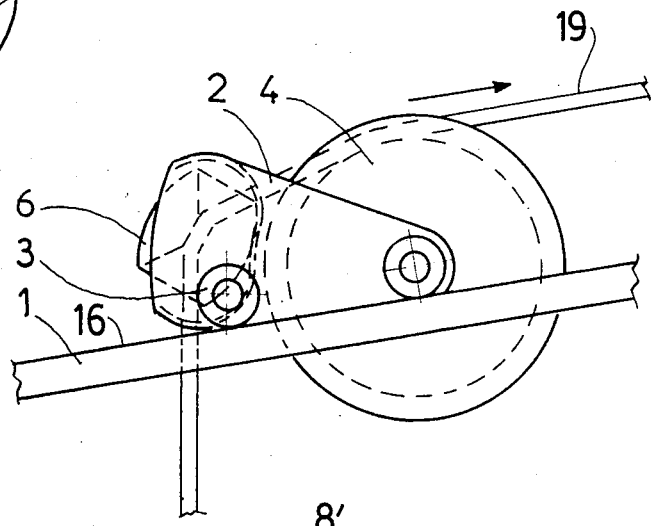

With the rollers 3 in the position shown at FIG. 4, in which the rollers are on track 1, it will be noted that cradle 2 has rotated to a position in which stop 6 is supported in the cradle and correspondingly, the entire weight of the load is supported on the track via the rollers 3, and the pull or tension exerted by the portion 19 of the cable serves to move carriage 12 to the right as shown at FIG. 4. Since the load is supported by the cradle 2 and rollers 3 the pull in portion 19 of the cable is only that required to traverse the carriage and load along the track. It is to be appreciated that the load acting downwardly on cradle 2 maintains rollers 3 in firm engagement with track 1.

Figure 5:
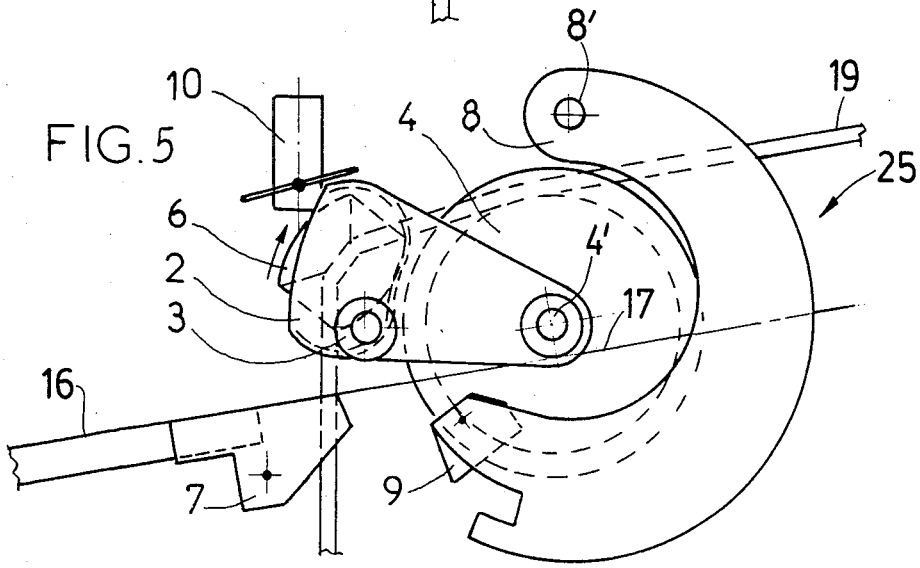

FIG. 5 shows the arrangement at unloading station 25. As shown at FIG. 5, there is a fork-shaped arcuately curved pulley stop 8 which is mounted to pivot about an axle 8' which is above the axis of axle 4' of the pulley. As pulley 4 moves to the position shown at FIG. 5 the pulley engages the fork-shaped stop 8, which arrests traverse of the pulley and causes tension in the portion 19 of the cable to pivot stop 6 and cradle 2 clockwise, to a position in which rollers 3 pivot upwardly away from track 1. In this position as ahown at FIG. 5, the cable again supports the load. As a result, there is an increased force acting to move pulley 4 more fully into engagement with the stop fork 8.

Figure 6:
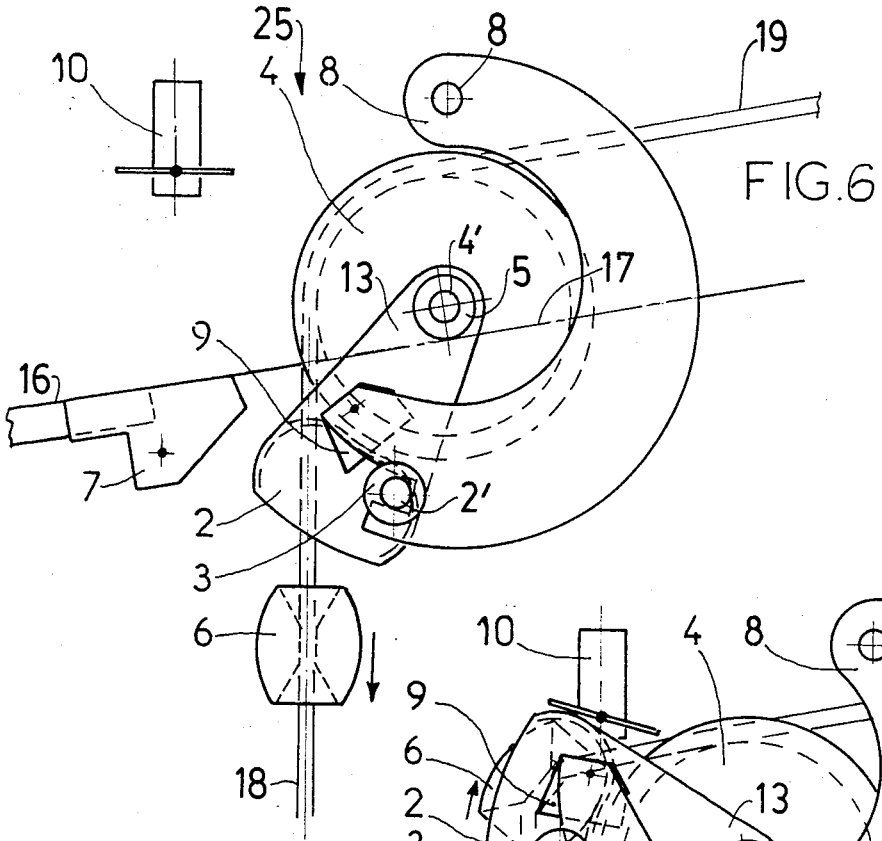

As cradle 2 pivots upwardly, it engages an end of travel switch 10 that reverses the winch 21. In the position shown at FIG. 5, rollers 3 are beyond the ends of their rails, so that yoke 13 can pivot downwardly to the position shown at FIG. 6 in which the cable stop 6 is released from cradle 2, so that the load can move downwardly as the cable is released by reverse driving of the winch. As shown at FIG. 6, stops are provided on stop fork 8 to limit the extent of downward, i.e. counterclockwise, pivoting of clevis 13, at station 25. Catches 9 are provided on stop fork 8, and these catches can be spring loaded to permit the rollers 3 to move to the position of FIG. 6.

It is to be appreciated that the load as it is lowered is deposited precisely at the position of station 25. Another load can then be connected to the cable to be hoisted and moved to the station 24, or the cable can be hoisted without a load for movement to the station 24.

Figure 7:
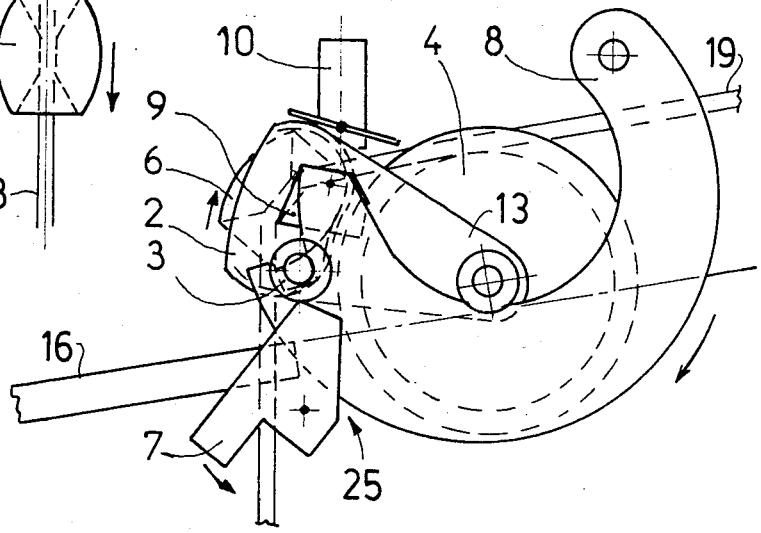
Figure 8:
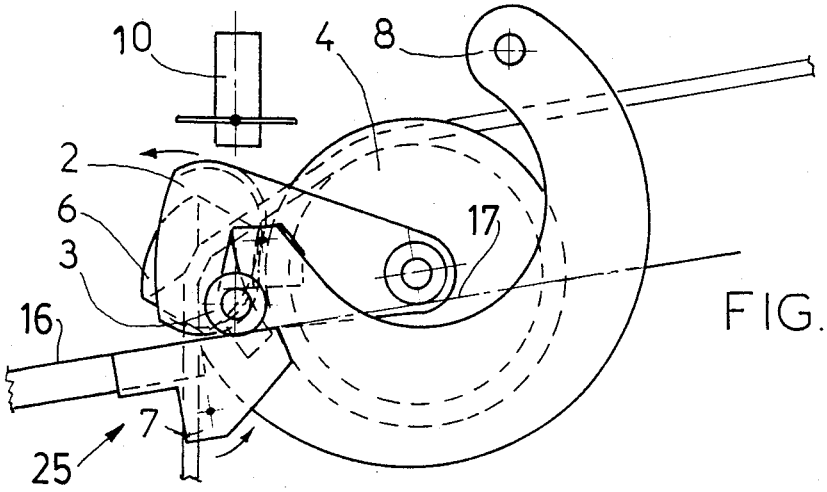

During hoisting at station 25, cable stop 6 first engages cradle 2. Continued pull on portion 19 of the cable causes clevis 13 to pivot clockwise, and also pivots stop fork 8 clockwise as a result of engagement of axles 2' of rollers 3 with the catches 9. Such pivoting of stop fork 8 results in some movement of pulley 4 to the left as cradle 2 pivots. The ends of the rails 16 take the form of pivotal pawls 7 which are pivoted upwardly by cradle 2 as a result of engagement of nose portions of these pawls with axles 2' of rollers 3. As axles 2' pass above the ends of pawls 7 the pawls are released to move to the position shown at FIG. 8 in which the pawls 7 form a continuation of track 16. Slightly after pawls 7 are released, the pull in portion 19 of the cable pivots cradle 2 to a position in which it again engages reversing switch 10 to reverse winch 21 thereby again permitting clevis 13 and rollers 3 to pivot downwardly, i.e. counterclockwise, as shown at FIGS. 7 and 8. The clevis pivots counterclockwise until rollers 3 engage pawls 7 to fully support the load via the action of cradle 2 on cable stop 6. Continued release or paying out of the cable from winch 21 causes the cradle with the pulley thereon to move toward station 24, with rollers 3 on rails 16, and roller 5 on rails 17.

In the embodiment of FIGS. 3–8, track 1 slopes upwardly from station 24 toward station 25. The extent of slope or inclination is sufficient that the carriage rolls because of gravity from station 25 to station 24. However, as will later be explained, pulling apparatus can be provided to pull the carriage from station 25 to station 24 while using a level or horizontal roller track 23.

When carriage 12 reaches station 24 (FIG. 3) and rollers 3 reach the end of the track the rollers roll downwardly around ramps 12, again releasing cable stop 6 and permitting the cable stop (and any load supported by the cable) to be lowered. While not shown at FIG. 3, a stop can be provided to prevent pulley 4 from rolling off track 1, toward the left from the position shown at FIG. 3.

As is apparent from FIG. 19, the pair of rails 16 is spaced inwardly from the pair of rails 17. As explained above, the rails 16 terminate or are made discontinuous at stations 24 and 25 to provide a gap or space through which the rollers 3 can pivot downwardly to the positions shown at FIGS. 3 or 6. However, at station 25, the rails 17 which support the pulley axle 4' via the rollers 5 is continuous so that the pulley 4 is always supported on track 17 by the rollers 5. A significant feature of Applicant's invention is that when the cradle 2 is in the position shown at FIG. 4, with rollers 3 on rails 16, the load is positively held, which eliminates the danger of any inadvertent lowering of the load except at the stations 24 and 25. This arrangement also minimizes the tension in portion 19 of the cable during traverse of the carriage along the rails. Further, it will be noticed with reference to FIGS. 3 and 6, that while the load is lowered, and cable stop 6 is below cradle 2, the carriage 12 is positively locked at the respective stations 24 and 25. Correspondingly, an accidental traverse while the load is being lowered or hoisted is positively prevented.

FIGS. 9 through 18 show another arrangement for locking and unlocking the load at the stations 24 and 25.

In the embodiment of FIGS. 9 through 18, the track arrangement 101 again includes two pairs of tracks like tracks 16 and 17 of FIG. 19. Rollers 105 on opposite sides of pulley 104 roll along track 17 which is continuous between the stations 24 and 25, and rollers 103 roll along rails 16 between the stations 24 and 25. The rails 16 are, of course, discontinuous at each of the stations to permit rollers 103 and the clevis or yoke 102 to pivot downwardly at each station.

Figure 9:
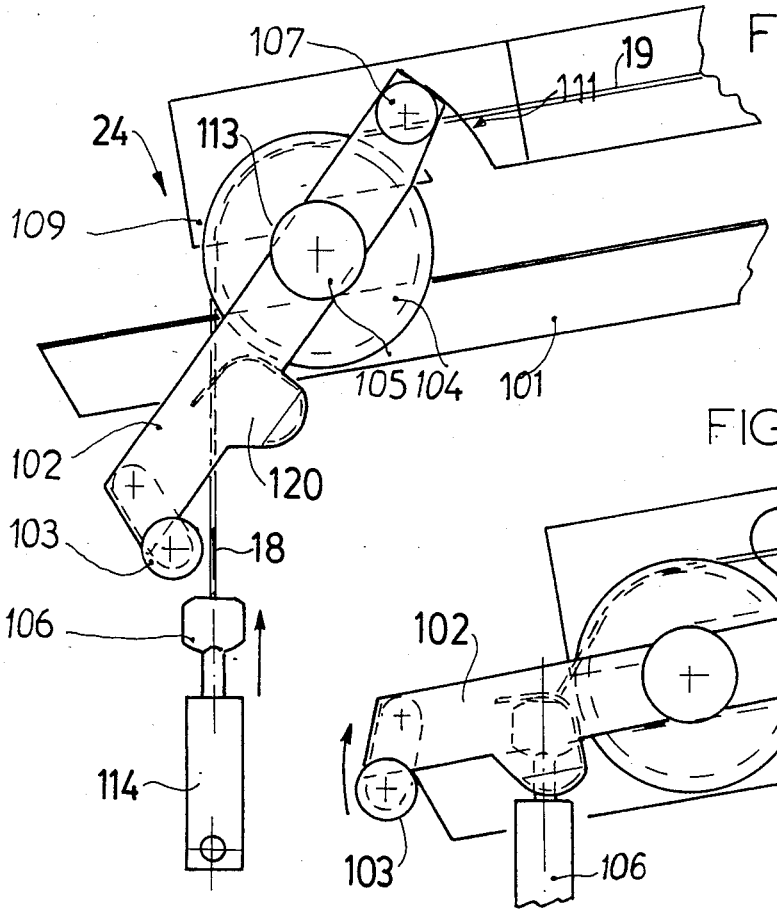

As shown at FIG. 9, the clevis or yoke 102 is extended at the end opposite rollers 103 to receive rollers 107. Yoke 102 again includes a socket 120 and hoisting cable 18 extends through the slot and verticle space in yoke 102 and socket 120.

As shown at FIG. 9, station 24 includes an further track 109 which has a curved abutment 113 that engages rollers 105 to arrest the motion of the carriage when rollers 105 reach abutment 113. In addition, the track 109 has two circular slots 111 to receive the rollers 107, as shown at FIG. 9.

As shown at FIG. 9, cable stop 106 is located at the upper end of a hook support 114.

Figure 10:
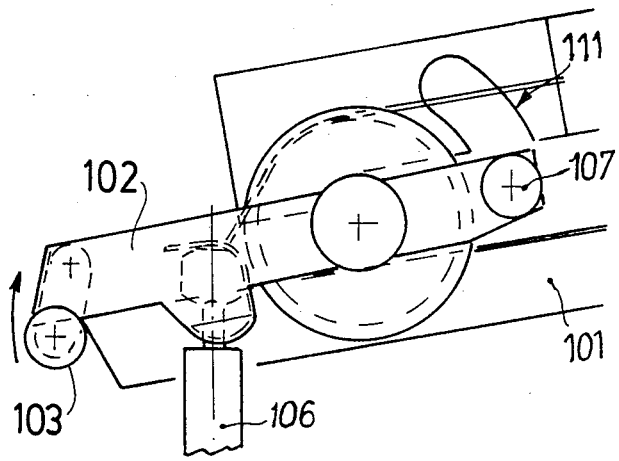
Figure 11:
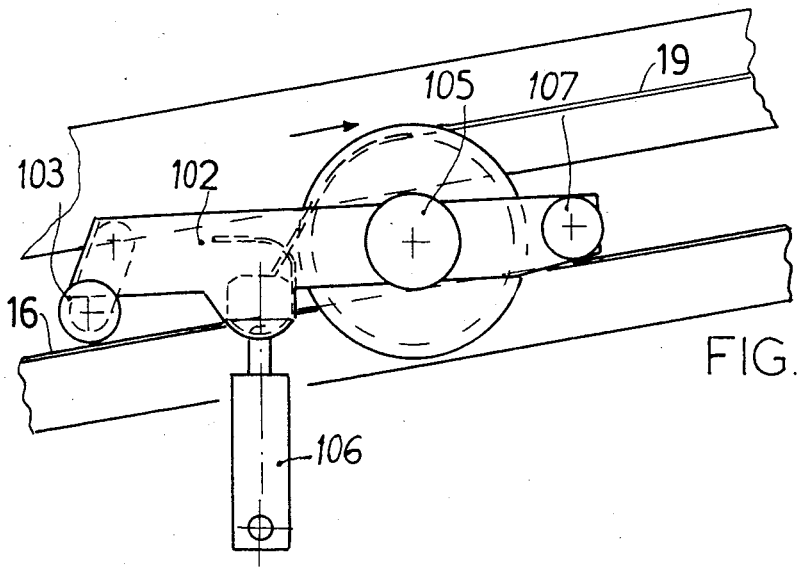

During hoisting at station 24, cable stop 106 enters the cradle or socket 120 and engages the cradle to pivot yoke 102 clockwise to the positions shown at FIG. 10 and then FIG. 11. As yoke 102 pivots clockwise, rollers 107 leave the slots or ramps 111, and rollers 103 pivot upwardly around the end of track 101 to the position shown at FIG. 11 in which rollers 103 are above and engage their rails 16. As soon as rollers 103 move upwardly to the level of track 16, the carriage is released, and moves to the right as shown at FIG. 11, as a result of the pull exerted by the portion 19 of the cable by the winch.

Figure 12:
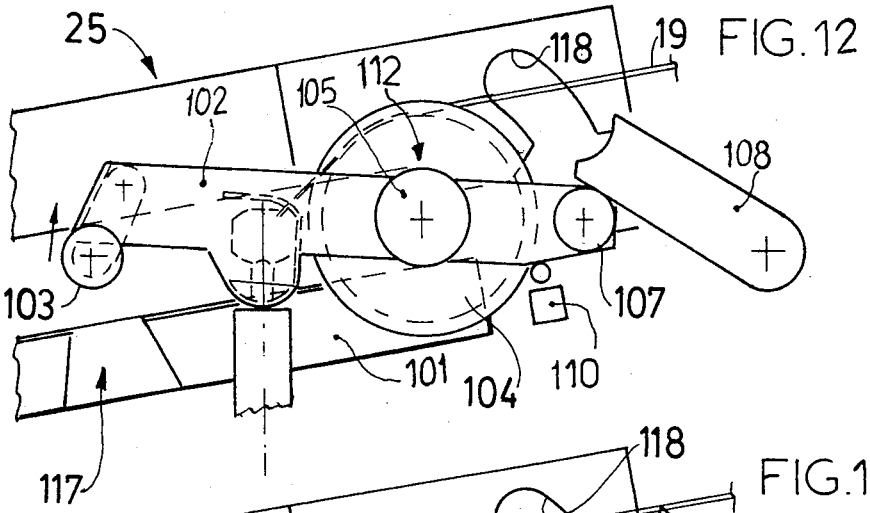

At station 25, as shown at FIG. 12, stops 112 are provided to engage rollers 105 to thus arrest the traverse of the carriage and pulley 104. When rollers 105 engage stops 112, the continuing pull in portion 19 of the cable causes yoke 102 to pivot clockwise as shown at FIG. 12 thereby lifting rollers 103 from rails 16 as the rollers reach the gap or space 117. As yoke 102 pivots clockwise, the portion of the yoke adjacent rollers 107 actuates reversing switch 110 which reverses the winch to unwind the cable. The load then causes yoke 102 to pivot counterclockwise so rollers 103 pass through gap 117, and rollers 107 pivot upwardly into downwardly opening arcuate grooves 118 of an upper track or rail, to the intermediate postion shown at FIG. 13. As yoke 102 continues to pivot counterclockwise, cradle 120 moves out of the path of cable stop 106 and the cable stop is released from the cradle whereup the load is controllably lowered by the winch. Engagement of the rollers 107 with the upper end of grooves 118 limits the extent of counterclockwise pivotal movement of the yoke 102 to the position shown at FIG. 14. With rollers 107 in grooves 118, the carriage is locked at station 25 and cannot traverse.

Figure 13:
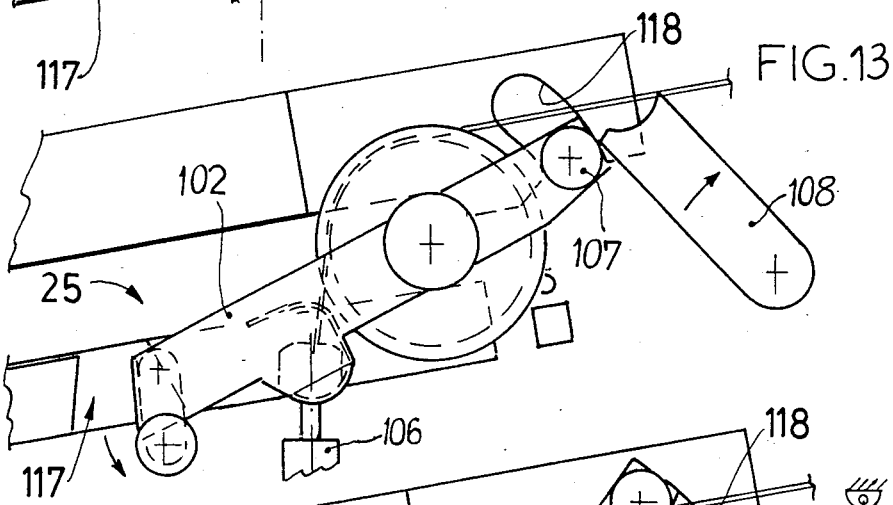
Figure 14:
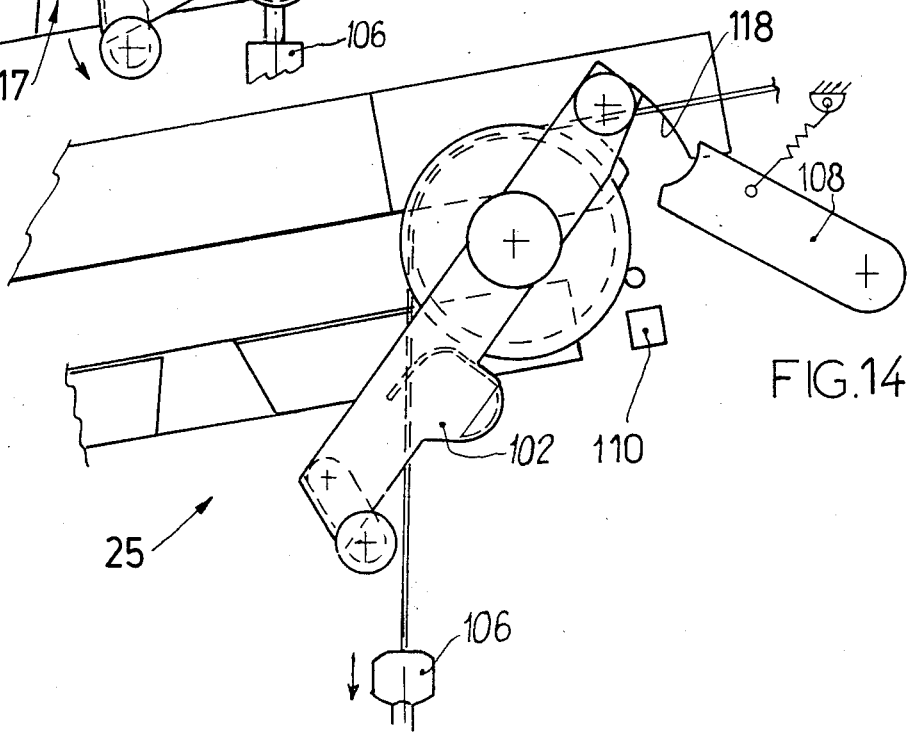

As shown at FIGS. 12 through 18, there are levers 108 to the rear of station 25. These levers have a normal at rest position as shown at FIG. 14, and in which the levers are maintained, for example, by a tension spring 108' which is relaxed when the levers are in the position of FIG. 14. As rollers 107 move from the position of FIG. 12 to the position of FIG. 13 in which the rollers entered grooves 108, rollers 107 engage levers 108 to pivot the levers out of the way, thereby permitting the rollers to enter grooves 118, as shown at FIG. 13.

Figure 15:
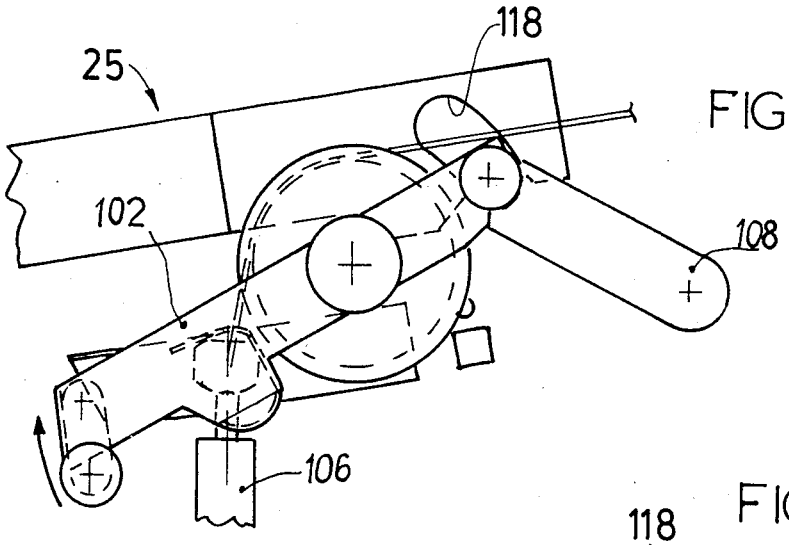
Figure 16:
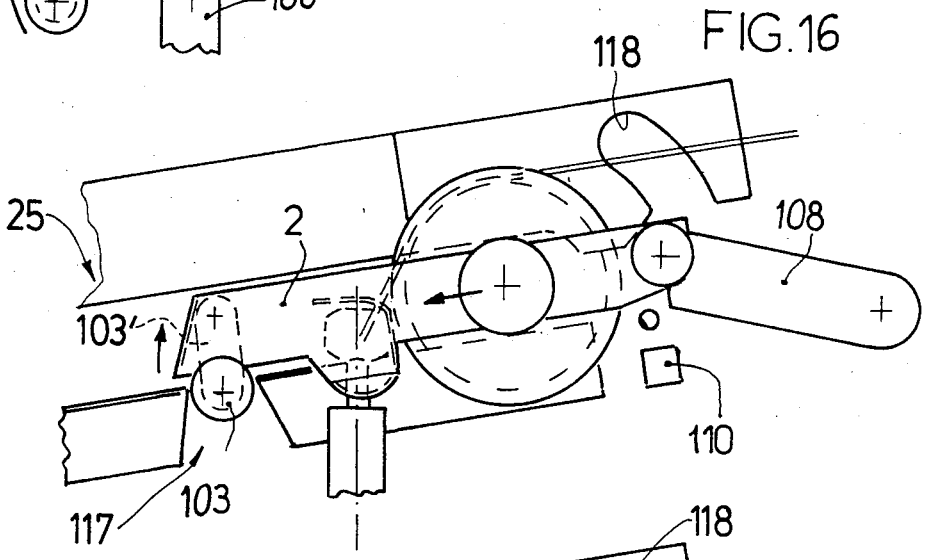
Figure 17:
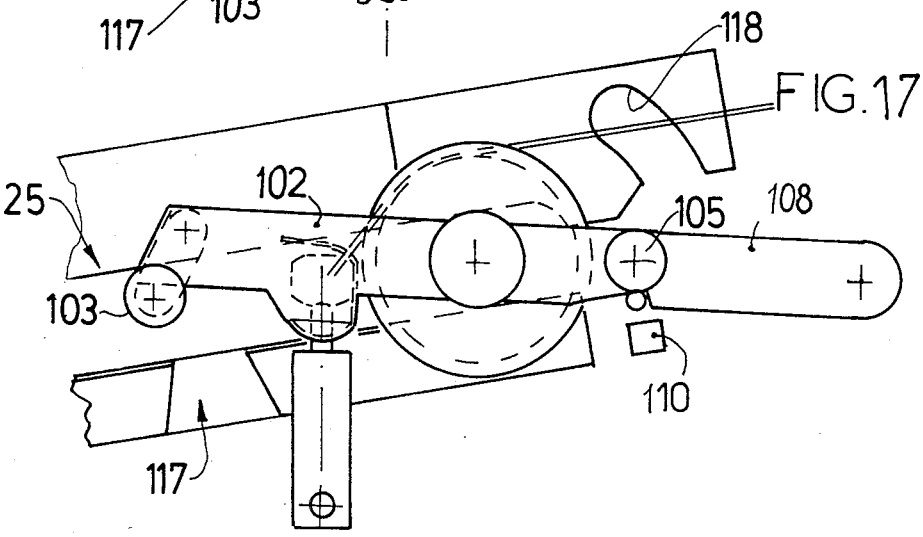

As a load is again hoisted at station 25 (FIG. 15) cable stop 106 again engages yoke 102 to pivot the yoke clockwise. Then rollers 107 reach the position shown at FIG. 15, the rollers engage the correspondingly, curved ends of levers 108 so that continued clockwise pivoting of yoke 102 causes the rollers to pivot the levers 108 thereby camming or pushing the carriage and pulley 104 to the left, as shown in the sequence of FIGS. 15 to 17. When yoke 102 pivots clockwise to the position shown at FIG. 17, reversing switch 110 is actuated by the portion of the yoke adjacent rollers 107, which causes the winch to reverse thereby paying out cable from the winch and permitting the yoke to pivot counterclockwise to the position shown at FIG. 18 in which rollers 103 again engage the track.

Figure 18:
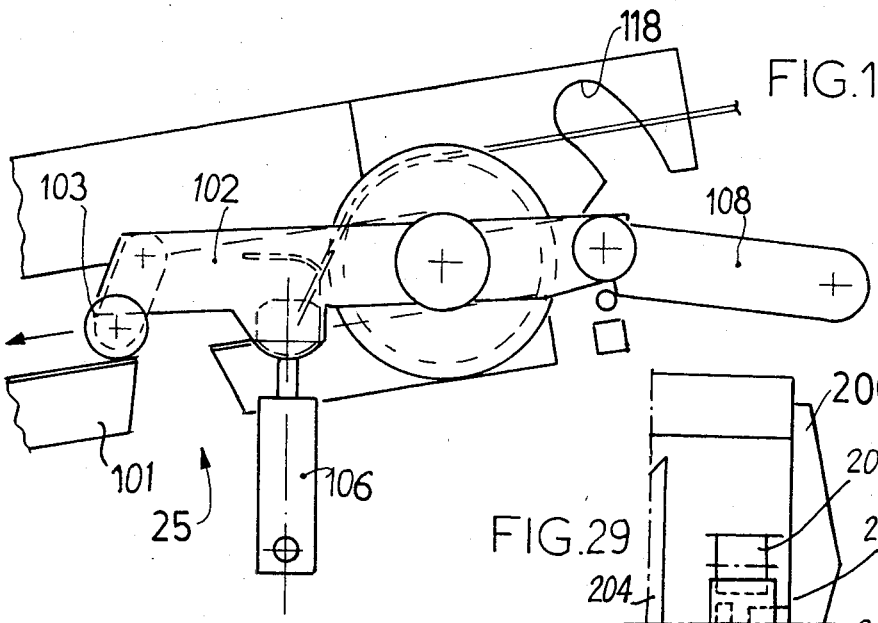
FIG. 18 shows the condition of the apparatus during the start of traverse toward the first station.

In the embodiment of FIGS. 12–18, rollers 103 are mounted on arms 103' which in turn are pivotally connected to yoke 102. These arms 103' are spring-loaded to normally maintain rollers 103 in a forwardly inclined position and against an adjacent stop surface on the yoke. FIGS. 12 through 15 show the rollers 103 and their arms 103' in this forwardly inclined position. Because of the action of the levers 108 which shift the pulley and carriage to the left, the rollers 103 are not aligned with the gap or space 117 in the track during clockwise pivoting of the yoke 102 to the position of FIG. 16. Correspondingly, the rollers 103 engage the front edge of the track at gap 117 which pivots the rollers rearwardly as shown at FIG. 16 during upward movement of the rollers 103 through space 117. As soon as the rollers 103 are above the track, the rollers snap forward on the yoke to the normal forward inclined position shown at FIG. 17 so that when the winch reverses, the rollers descend onto the track as shown at FIG. 18. In the position shown at FIG. 18, the entire load is again supported completely by the carriage, independently of the cable, since the cable stop 106 is within cradle 120, and the carriage is again supported by rollers 105 and 103 which engage the tracks or rails.

The carriage with the load so supported, then rolls by gravity along track assembly 104, back to station 24, where the load is automatically released and lowered when roller 103 reaches the end of track 101, as shown in the sequence of FIGS. 10 and 9. When roller 103 reaches the position of FIG. 10 with respect to track 101, the weight of the load on cable stop 106 causes yoke 102 to pivot downwardly, eventually reaching a position in which cradle 120 is out of the path of cable stop 106 so that the cable 18 lowers the load under the controlled action of the winch.

In the embodiment of FIGS. 3–8 the cable stop 6 was shown to be a generally spherical element which surrounds the cable and is pressed or squeezed onto the cable in the usual way. The ends of the opening in cable stop 6 are countersunk or flared to prevent damage to the cable. The cable or hoisting stop can, however, be the upper end of the lifting hook shown at FIGS. 20 and **20*a*. As shown, the ball or stop 61 is directly secured to the stirrup or yoke 62 which pivotally supports hook 63 on the axle or shaft 65. For safety, cable 64 can extend around axle 65 and can be fastend to itself by a crimping connector 64. In addition, the stop or ball 61 is crimped or swaged onto the cable. The upper end of stop 61** is again flared to minimize damage to the cable.

Figures 20, 20A:
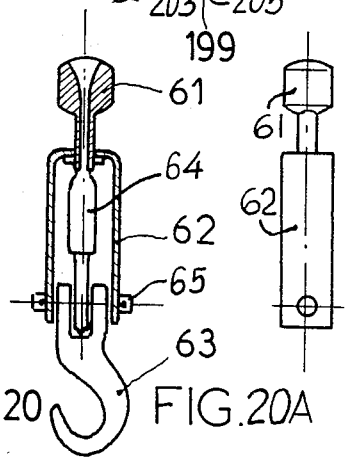
FIG. 20 is a view in partial section of a hoisting hook which can be used with the invention.
FIG. 20*a* is a partial side view of the upper portion of the hook of FIG. 20.

When the hook shown at FIGS. 20 and **20*a* is used, and the stop or ball 61 is within the cradle, the entire load is supported by the carriage on the tracks, wholly independently of the hoisting cable. This dependent support exists during the entire traverse of the carriage and load between the stations. Correspondingly, the load cannot be lowered except at the defined stations 24 and 25**.

Figure 21:
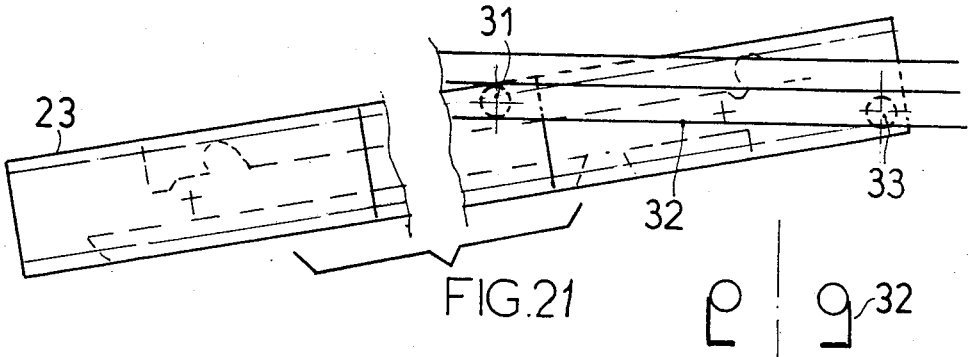
FIG. 21 shows another mounting arrangement for the monorail or track.
Figure 21A:
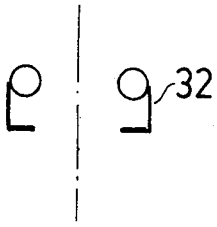
FIG. 21*a* is a schematic end view of the support rail of FIG. 21.

FIGS. 21 and **21*a* show a support arrangement for roller track 23 which permits displacing the roller track 23 so that the position of stations 24 and 25 is correspondingly changed. The support track 32 for roller track 23 is of the configuration shown at FIG. 21*a* to slidably receive axles or shafts 31 and 33 which are connected to and support roller track 23. A clamp arrangement (not shown) is associated with axle 33 to lock roller track 23 to rail 32 at the desired position of adjustment. In the embodiments disclosed thus far, the distance between stations 24 and 25 is constant and therefore, shifting roller track 23** shifts the location of both stations.

A third embodiment will now be described with with reference to FIGS. 22 through 28.

Figure 22:
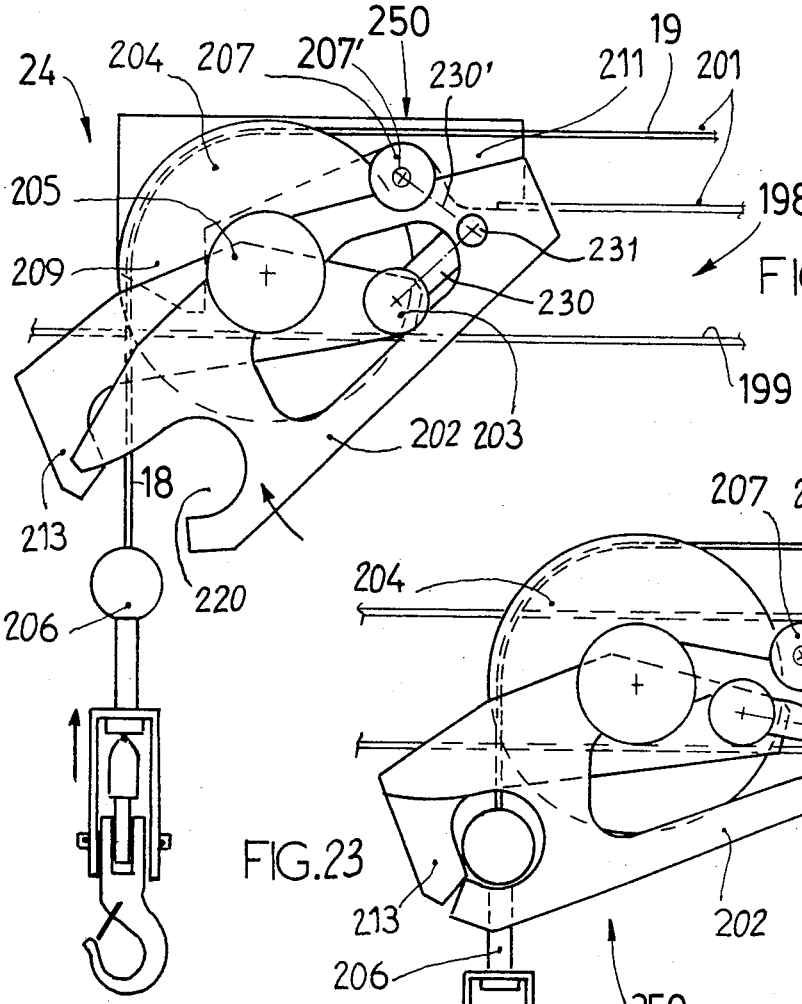

FIG. 22 shows a carriage 250 according to a third embodiment of the invention at station 24 with the various parts of the carriage shown in the position for hoisting or lowering a load. On carriage 250 is a pulley 204 which functions as a cable return means. The cable 18 extends downwardly from the pulley and has its other portion 19 which extends around pulley 204 connected to winch 21.

Figure 29:
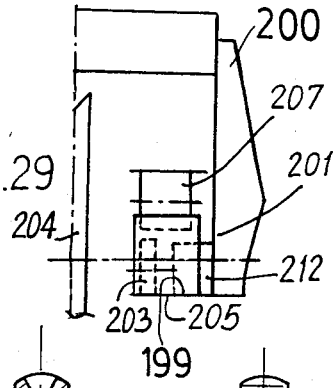
FIG. 29 is a view in section of the track or monorail of the third embodiment.

Track 198 along which carriage 250 can move has a lower rail 199 and an upper rail 201. Rails 199 and 201 are secured together by suitable side members such as members 200, as shown at FIG. 29.

Mounted on a central shaft of pulley 204 are live rollers 205, and a yoke 202 and a fork 213 are each mounted on the pulley axle for pivotal movement relative to each other. Yoke 202 is composed of two side plates on opposite sides of the plane of pulley 204, and fork 213 has a like portion on the opposite side of the pulley, even though only one side is shown in FIG. 22.

Connected to an axle 231 supported by the rear of yoke 202 are links 230 and 230'. Mounted on link 230 is a live roller 203 and mounted on link 230' is a live roller 207. The links 230 and 30' are spring biased to swing away from each other.

Track 201 has a stop 209 near its forward end which is engaged by rollers 205 to prevent movement of the carriage to the left from the position of FIG. 22. There is also a ramp like recess 211 in track 201, in which roller 207 can seat, as shown at FIG. 22. The axle 207' of roller 207 engages the top edge of yoke 202 to prevent further counterclockwise pivoting of yoke 202 from the position shown at FIG. 22. The engagement of roller 207 in the recessed ramp 211 locks carriage 250 against movement to the right.

Rollers 205 and 203 roll on the same track 199, but rollers 203 are inwardly of rollers 205 as shown at FIG. 29.

Figure 23:
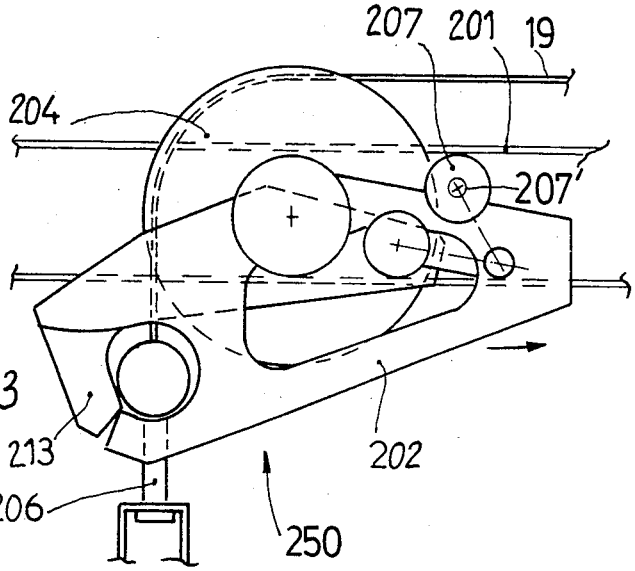
Figure 24:
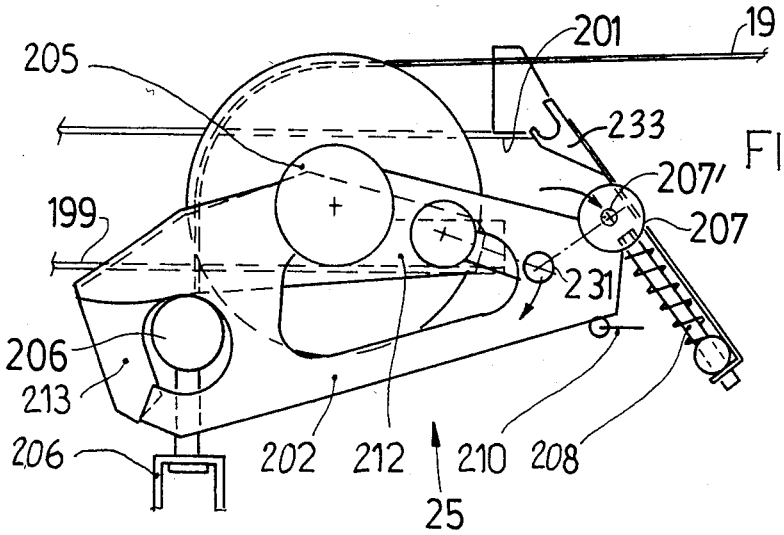

As a load is hoisted at station 24 (FIG. 22) by the action of the winch on portion 19 of the cable the cable stop or ball 206 moves upwardly and engages yoke 202, to pivot the yoke to the position shown at FIG. 23. As the yoke pivots from the position of FIG. 22 to the position of FIG. 23, roller 207 can move downwardly along ramp 211 and when the roller leaves ramp 211, the carriage is released from station 24 for traverse along the track. The yoke 202 is held against counterclockwise pivoting by the engagement of roller 207 with track 201, and by the engagement of its axle 207' with the upper edge of yoke 202. In this position, The socket portion 220 of the yoke fully supports the hoisted load independently of the cable, and correspondingly, the pull exerted on portion 19 of the cable by the winch traverses carriage 250 in the direction of this pull as shown at FIG. 23. At unloading station 25 (FIG. 24) when rollers 205 engage a stop 212, axles 231 are beyond the righthand end of track 199. Continued pull on portion 19 of the cable by the winch causes yoke 202 to pivot clockwise to the position shown at FIG. 24 in which the link axle 231 moves to a sufficient distance below track 201 that spring biased link 230' can move or flip roller 207 to a rearward position in which its axle 207' engages the top edge of yoke 202 at the rearward position shown at FIG. 24. Just after roller 207 flips to the rearward position, yoke 202 engages reversing switch 210 to reverse the winch so the movement of the cable reverses. This reversing of the cable movement causes ball 206 to push downwardly on the socket portion 220 of yoke 202 thereby pivoting yoke 202 counterclockwise to the position shown at FIG. 25. During this pivoting, roller 207 pivots lever 208 clockwise so that rollers 207 can move upwardly across ramp 232 to the position shown in the sequence of FIGS. 25 and 26. When the axle 207' of rollers 207 clears the fork end 233 of lever 208, the lever returns to its normal position shown at FIG. 26.

Figure 25:
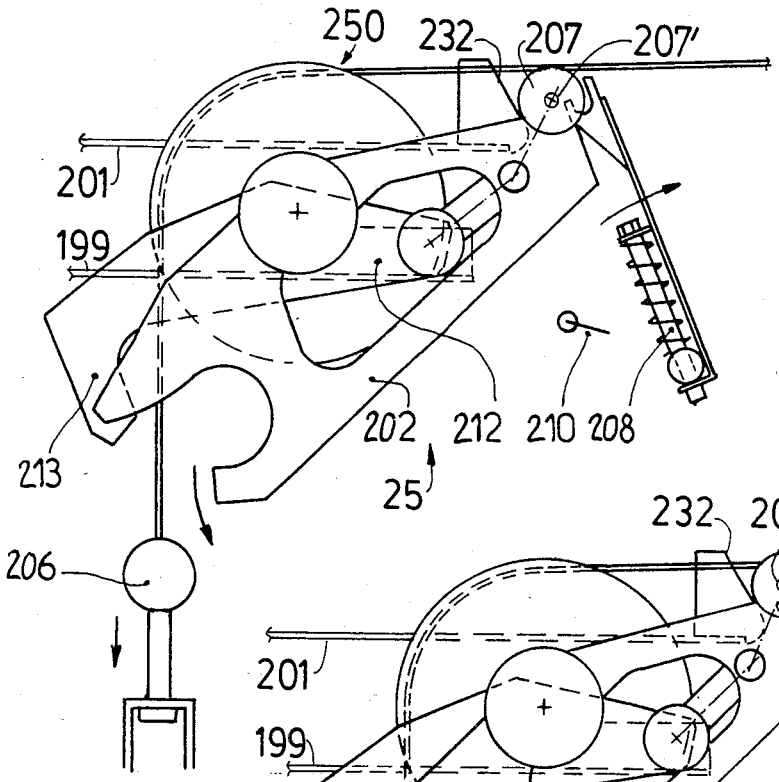

When rollers 207 are behind ramp 232 as shown at FIG. 25, the carriage 250 is locked against movement to the left, at the station 25. The load is thus lowered while the carriage is locked and wholly prevented from rolling along the track.

Figure 26:
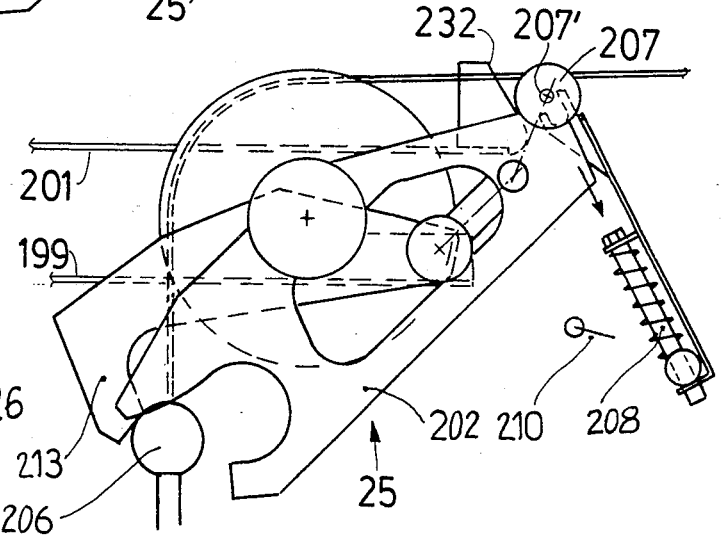
Figure 27:
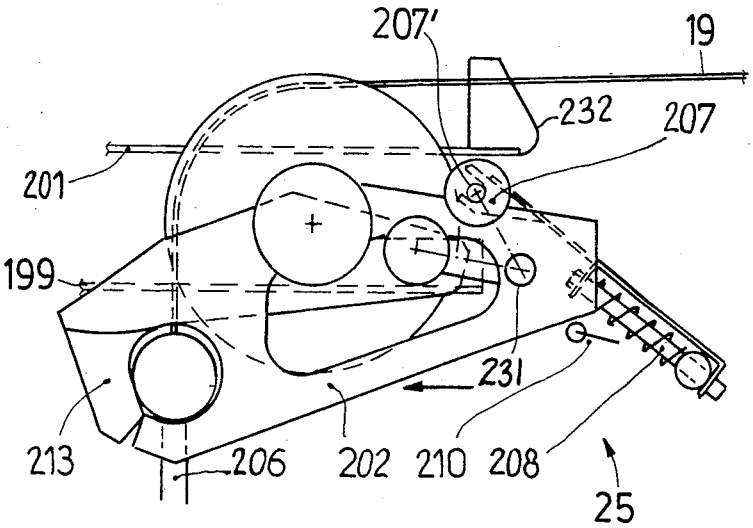

As a new load is lifted at station 25, ball 206 again engages yoke 202 to pivot the yoke clockwise from the position of FIG. 26. As the yoke pivots clockwise, roller 207 moves downwardly along edge or ramp 232 until a position is reached in which axle 231 is a sufficient distance below track 201 that the stronger spring of lever 208 forces roller 207 to its forward position relative to yoke 202, as shown at FIG. 27. Slight additional clockwise pivoting of yoke 202 because of the pull exerted on portion 19 of the cable by the winch causes yoke 202 to engage and actuate reversing switch 210 which again reverses the winch and the direction of the cable. The initial reverse movement of the cable causes cradle 220 to receive the full weight of the load via the ball 206 as the ball moves downwardly into the cradle. With roller 207 in the position shown at FIG. 27, yoke 202 cannot pivot counterclockwise, and the load is again completely supported by the carriage independently of the tension in portion 19 of the cable.

Figure 28:
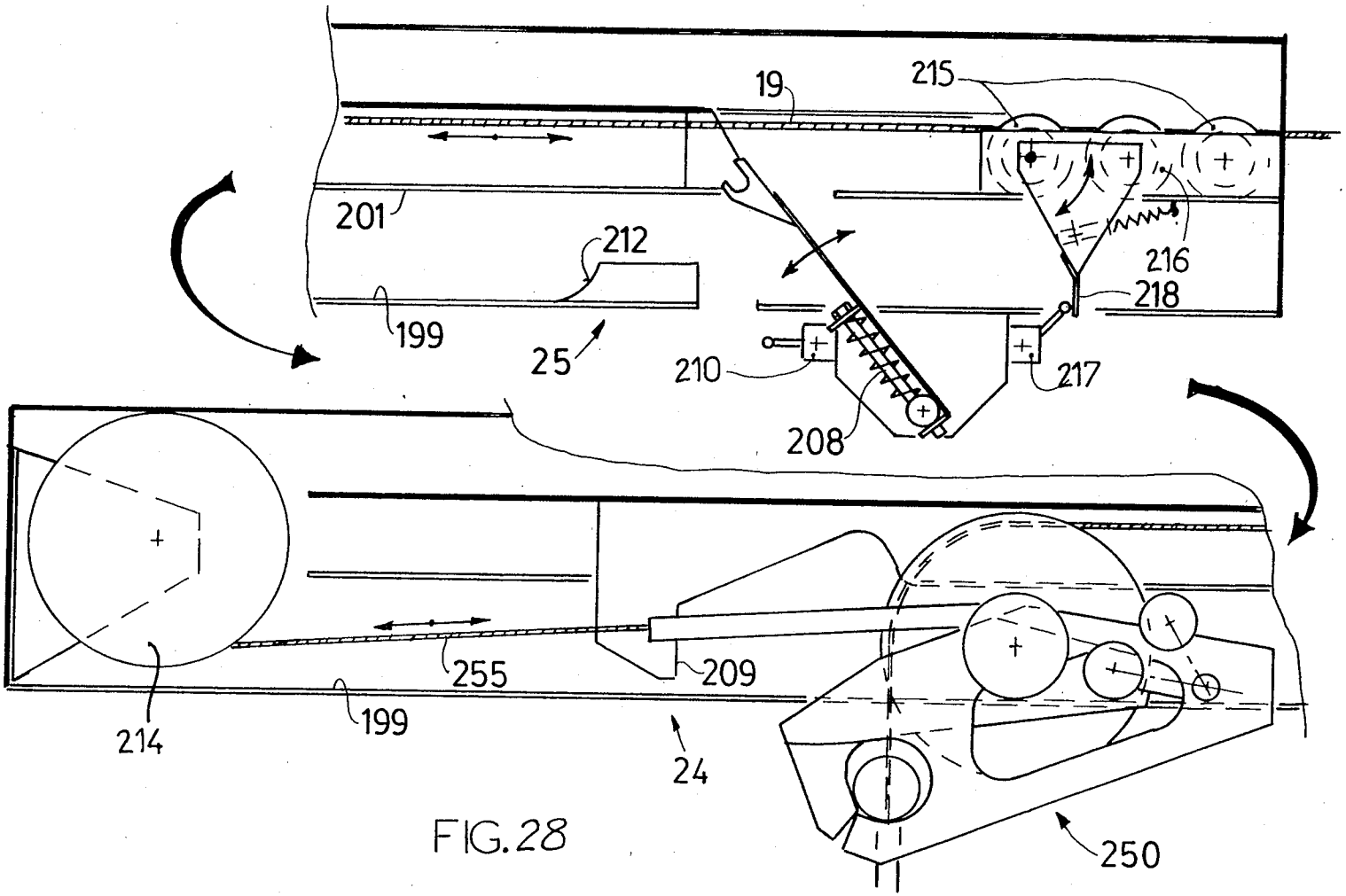
FIG. 28 is an enlarged side view showing additional modifications to the third embodiment.

The track 198 shown for the embodiment of FIGS. 22–28 can have horizontal rails 201 and 199 which are not inclined. To return the carriage to station 25, a spring loaded winding drum 14 can be provided as shown at FIG. 28. This winding drum 214 is connected to the carriage by cable 255, and the force exerted by the winding drum, which is spring loaded, pulls the carriage 250 and the load it supports, along the track from station 25 to station 24, as cable 19 is unwound from the winch.

When the carriage 250 again arrives at station 24, the carriage is stopped by stops 209, rollers 207 roll into the recessed ramp 11 so the load pivots yoke 202 and cradle 220 to the position shown at FIG. 22 in which ball 206 is released, and the load is controllably lowered by continued unwinding of cable 19 from the winch.

The apparatus can also include an arrangement for automatically stopping the winch when the load is fully lowered at the stations 24 or 25. As shown at FIG. 28, the portion 19 of the cable which has its righthand end connected to the winch, extends over a cable slack detector of known type which is composed of fixed rollers 215 and a movable roller 216 which pivots arm 218 in response to a slack cable. Such pivoting of roller 216 actuates a switch 217 which de-energizes the winch and stops further paying out of the cable.

The fork-shaped member 213 has a nose portion which encloses the front opening of cradle 220 to positively prevent the movement of ball 206 out of the cradle between the stations 24 and 25. The axles on which rollers 203 are mounted slide in the fork elements 213 and serve to prevent clockwise pivoting of these elements so that ball 206 cannot leave the cradle when the carriage is between stations 24 and 25.

It is to be appreciated that the carriage arrangements of the first and second embodiments, i.e. the embodiments of FIGS. 3–8 and FIGS. 9–18, can operate on a horizontal track, rather than an inclined track, where a return device such as the winder 214 is provided to move the carriage from station 25 to station 24, as cable 19 is paid out from the winch. In addition, the slack detector shown at FIG. 28 can also be used with the fist and second embodiments to automatically shut off the winch in response to slack cable when the load is lowered. Hoisting can then again be resumed by a worker, after connecting the cable hook to a new load, simply by pulling on the cable and maintaining the tension in the cable until the cable supports part of the new load, or a hoisting switch can be provided at each station.

It is to be noted that in the first embodiment of FIGS. 3–8, the element 8 which provides for locking and unlocking the load at station 125 has its pivotal axis above the axis of the pulley 4. In contrast, the levers 108 of the second embodiment, and which move the carriage to a position in which the load is locked to the carriage have their axes below the axis of pulley 104. These axes could, of course, be essentially at the level of the axis of pulley 104, if desired.

In the third embodiment of FIGS. 22–28, the lever 208 and its spring perform the function of locking the load to the pulley, and the pivotal axis of this lever can be as required to simply cause cause rollers 207 to be forced to their forward positions as shown at FIG. 27.

It is to be appreciated that these locking and unlocking arrangements can readily be made movable or adjustable simply by mounting the required elements on a carriage which can be moved to different positions to perform the desired function. Also, the distance between stations can be varied as desired, by simply adding sections of rail or track between the stations to provide the desired distance.

While several embodiments have been disclosed showing a simple pulley on the carriage, multiple pulley or reeving systems can be used to increase the load which can be lifted and handled.

As previously indicated the horizontal track of FIG. 28 (and which is also shown at FIG. 2) is connected to its support rail 26 by axle or spindle-type connections which facilitate movement of track 23 to different locations, thereby changing the location of the respective stations 24 and 25.

Numerous changes and variations can be made without departing from the scope of this invention.

I claim:

1. Load hoisting and traversing apparatus comprising a roller track, a carriage movable along said roller track, cable return means on said carriage, a hoisting and traversing cable extending around said cable return means, drive means spaced from said carriage for driving said cable to hoist a load and to traverse said carriage for driving said cable to hoist a load and to traverse said carriage along said roller track, first rollers on said carriage pivotally supporting said carriage on a first part of said roller track for pivotal movement between a hoisting position and a traversing position, second rollers mounted on said carriage for preventing pivoting movement of the carriage from the traversing position to the hoisting position while said second rollers engage a second part of said roller track, and for allowing said pivotal movement to said hoisting position at an interruption of said second part of the roller track in at least one hoisting location, cooperating locking means on said carriage and on said roller track for locking the carriage against traversing movement along the roller track when said carriage is in its hoisting position in said hoisting location, support means on said carriage for supporting a load, and stop means attached to said cable for driving said carriage from said hoisting position to said traversing position upon engaging said support means during hoisting, and for securing said cable to the carriage when the carriage is in said traversing position.

2. Apparatus according to claim 1 wherein said cooperating locking means include at least one locking roller mounted on said carriage, and a recess in said roller track, said recess forming a track for allowing the locking roller to roll thereon when the carriage is driven from one of its hoisting or traversing positions to its other position.

3. Apparatus according to claim 2 wherein said recess comprises an interruption of the second part of the roller track allowing said pivotal movement of the carriage, and the locking rollers comprise said second rollers of the carriage.

4. Apparatus according to claim 1 wherein said cable return means comprises a pulley mounted on said carriage about the same axis as the first rollers, and said cable extends around said pulley.

5. Apparatus according to claim 1 further comprising stop means for stopping said carriage at an unloading location, and means for automatically reversing said drive means at said unloading location in response to tilting of the carriage by the cable after the carriage is stopped by said stop means.

6. Apparatus according to claim 5, wherein said second rollers are mounted on a first link pivoted on said carriage and biased towards said second part of the roller track, so that said second rollers disengage from said second part of the track when the carriage is tilted at the unloading location, and the carriage can pivot to its hoisting position after the reversing of said drive means, and further comprising means at said unloading location for re-engaging said second rollers on said second part of the roller track when the carriage is driven from its hoisting position back to its traversing position.

7. Apparatus according to claim 6 comprising third rollers mounted on a second link pivoted on said carriage and biased to swing away from said first link, said third rollers engaging a third part of said roller track.

8. Apparatus according to claim 6, wherein said re-engaging means include a telescopic pivoting lever having a fork-shaped end for engaging the axis of said second rollers.

9. Apparatus according to claim 1 wherein said stop means are mounted on a yoke which supports a hoisting hook, and the cable is connected to said hook.

10. Apparatus according to claim 1 wherein a gap is formed in said second part of the roller track at an unloading location for allowing said second rollers to pass downwardly through said gap and said carriage to pivot to its hoisting position, and re-engaging means are provided to push the carriage back towards said hoisting location, in response to the carriage being driven back to its traversing position and said second rollers passing upwardly through said gap, thus allowing re-engagement of said second rollers with said second part of the roller track.

11. Apparatus according to claim 10 wherein said re-engaging means comprises a pivoting lever engaging said carriage for imparting a traversing movement to the carriage when said carriage is pivoted from its hoisting position to its traversing position.

* * * * *